US007360566B2

(12) United States Patent
Chang

(10) Patent No.: US 7,360,566 B2
(45) Date of Patent: Apr. 22, 2008

(54) STRUCTURE OF AUTOMATIC PENCIL SHARPENER

(76) Inventor: Shen-Hsiung Chang, No. 1, Lane 46, Xingren Rd., Danshui Town, Taipei County (TW)

( * ) Notice: Subject to any disclaimer, the term of this patent is extended or adjusted under 35 U.S.C. 154(b) by 0 days.

(21) Appl. No.: 11/205,171

(22) Filed: Aug. 17, 2005

(65) Prior Publication Data

US 2007/0039663 A1 Feb. 22, 2007

(51) Int. Cl.
*B43L 23/00* (2006.01)

(52) U.S. Cl. ..... 144/28.5; 144/28.72

(58) Field of Classification Search ..... 144/28.1–28.9; 30/451–462

See application file for complete search history.

(56) References Cited

U.S. PATENT DOCUMENTS 2,094,549 A * 9/1937 Miller ..... 144/28.71
2,214,890 A * 9/1940 Rhodes, Jr. ..... 200/61.59
2,624,317 A * 1/1953 Tall ..... 144/28.71
3,952,784 A * 4/1976 Holland ..... 144/28.1
3,998,253 A * 12/1976 Kerr, Jr. ..... 144/28.1
6,470,929 B2 * 10/2002 Fregeolle ..... 144/28.72

* cited by examiner

*Primary Examiner*—Shelley M. Self
(74) *Attorney, Agent, or Firm*—Birch, Stewart, Kolasch & Birch, LLP

(57) ABSTRACT

An automatic pencil sharpener has a plurality of different sizes of pencil selector openings in a front side of a pencil selector panel, and an annulus groove at the back side of the pencil selector panel for mounting the trigger. Accordingly, the pencil inserted into the pencil receiving opening will keep a constant distance with the trigger switch, regardless of the sizes of the pencil inserted, thereby smoothing the pencil operation in the device.

4 Claims, 7 Drawing Sheets

STRUCTURE OF AUTOMATIC PENCIL SHARPENER

BACKGROUND OF THE INVENTION

I. Field of the Invention

The present invention relates to a device of an automatic pencil sharpener." In particular, the present invention relates to an improvement on the pencil selector panel which changes the position of the trigger switch with the rotation of the pencil selector panel to adjust the suitable pencil size.

II. Description of the Prior Art

A pencil is usually used in writing, artifact, and industrial drawing. In our daily life, there are various kinds of pencils (such as conventional, automatic, magic pencils, etc.). A conventional lead pencil has to be sharpened by a pencil sharpener from time to time. The wood covering the pencil lead needs to be sharpened into an appropriate conical shape to expose the lead. Therefore, it takes time to sharpen a conventional lead pencil manually. For most of consumers, it is difficult to sharpen the lead pencil manually into a good looking shape. The shape of the pencil will influence the mood of the user and may affect the way in which the user holds the pencil. Therefore, the pencil sharpening tools such as semi-automatic and automatic pencil sharpener are introduced into the current market. In general, semi-automatic pencil sharpener requires manual rolling forces to sharpen the pencil into preconfigured type by a rotary blade. Additionally, please also refer to the embodiment of FIG. 1, FIG. 2, and FIG. 3. The automatic pencil sharpener primarily comprises a rotary blade a1 powered by an automatic motor. The rotary blade a1 forms an angle with the axis of the pencil receiving opening a2. A switch component a3 is located in the inner side of the pencil receiving opening a2, The switch component a3 is designed to push the trigger a4. The trigger a4 covers a half of the pencil receiving opening a2. When in use, the pencil inserted into the pencil receiving opening a2 will push the trigger a4 which then releases the switch component a3 to start the motor, and drive the rotary blade a1 to sharpen the pencil b into an appropriate conical shape in a preconfigured angle. However, since the pencil receiving opening a2 is fixed, pencils with different sizes may not be inserted into the pencil receiving opening a2, and the sharpener will shake when the pencil of a smaller size is inserted into the pencil receiving opening a2. In order to solve this problem, a pencil selector panel a5 having a plurality of openings with different sizes was proposed so that the user can select an opening with a proper size by rotating the selector panel a5. However, in the conventional pencil sharpener, since the pencil is inserted into the opening to be in contact with and to push the trigger a4, the increased pressure on the pencil may make it difficult to insert the pencil into and remove the pencil from the opening.

SUMMARY OF THE INVENTION

It is therefore a primary object of the present invention to provide a device of an improvement on an automatic pencil sharpener.

It is a further object of the present invention to provide a device which can adjust the location of a trigger switch by the movement of pencil selector panel to make pencil insertion and more smoothly.

Thereafter, the automatic pencil sharpener primarily comprises a pencil sharpener body and pencil selector panel, and characterized by a plurality of different sizes of pencil selecting openings set up in front of the pencil selector panel which has an annulus groove at the rear side of the pencil sharpener body. The pencil selector panel is mounted on an emplacing groove located at the front side of the pencil sharpener body. A pencil receiving opening and a plurality of pawls are located in the emplacing groove. A trigger switch is arranged close to the pencil receiving opening and is within of a position groove. Above the trigger switch, a trigger key and a trigger corresponding to the size of annulus groove are fixed.

Accordingly, when assembling the pencil sharpener, the pencil selector panel is fixed to the emplacing groove, and the trigger of the trigger switch is inserted into the annulus groove of the pencil selector panel. Therefore, when rotating the pencil selector panel, the trigger will move along with the inner circumference of the annulus groove, and drive the trigger switch to move linearly along with position groove such that the location of the trigger key will be changed according to the selected pencil openings. Therefore, the pencil can be inserted into and removed from the openings more smoothly.

DETAILED DESCRIPTION OF THE PREFERRED EMBODIMENTS

Figure 1:
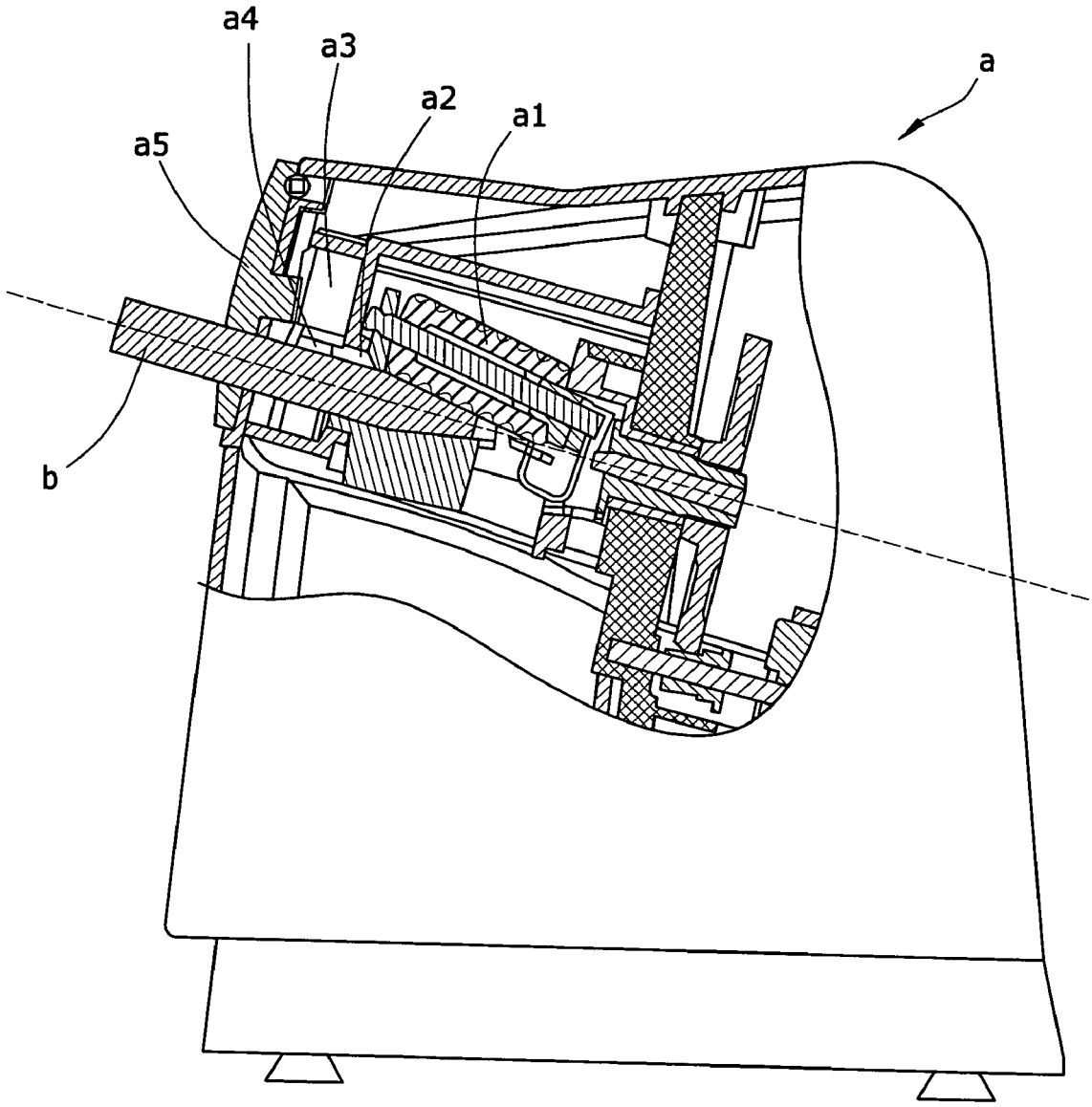
Fig.1(PRIOR ART)
FIG. 1 shows a cross-sectional view of a conventional pencil sharpener.
Figure 2:
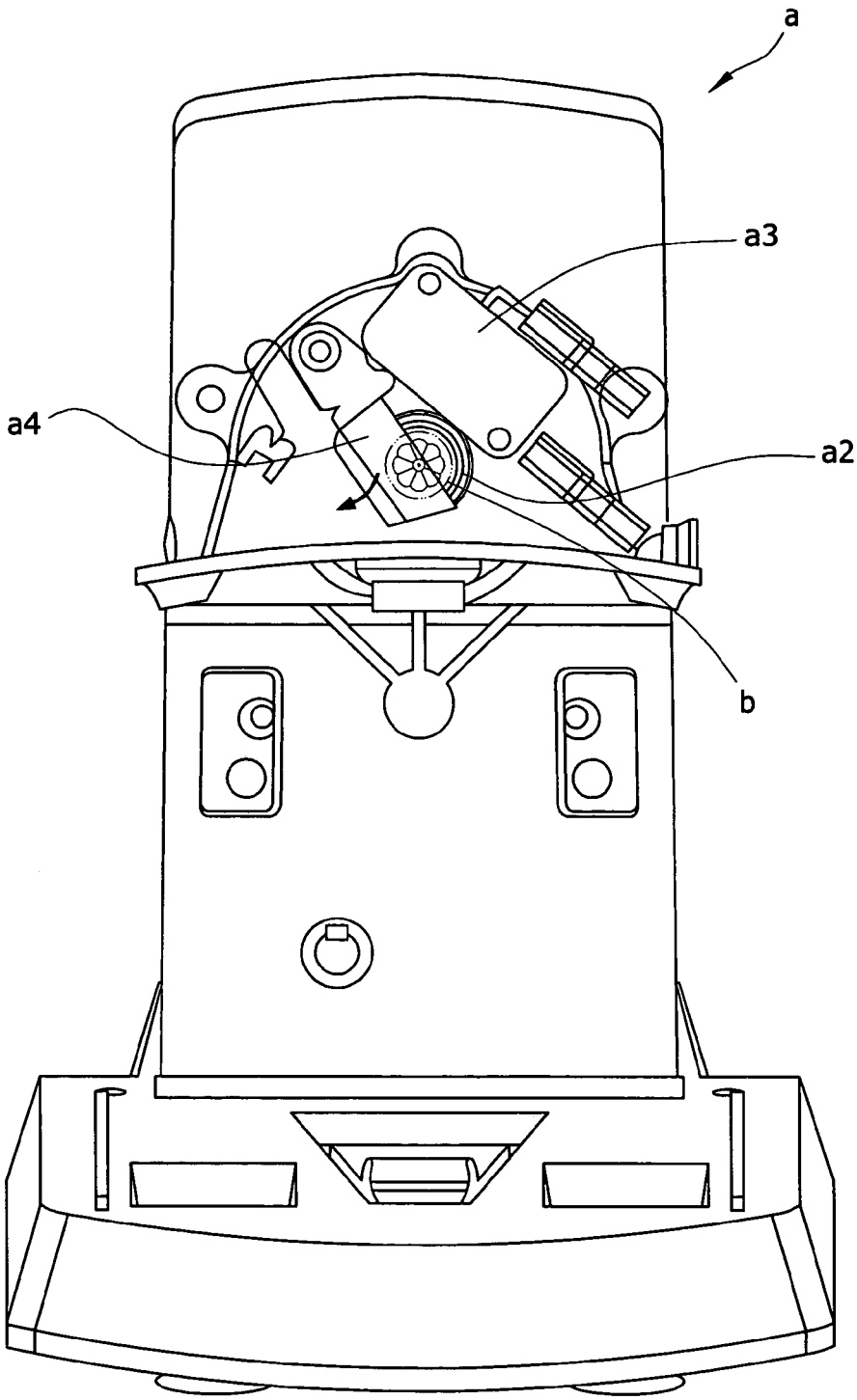
Fig.2(PRIOR ART)
FIG. 2 shows a front elevational view of the conventional sharpener (1)
Figure 3:
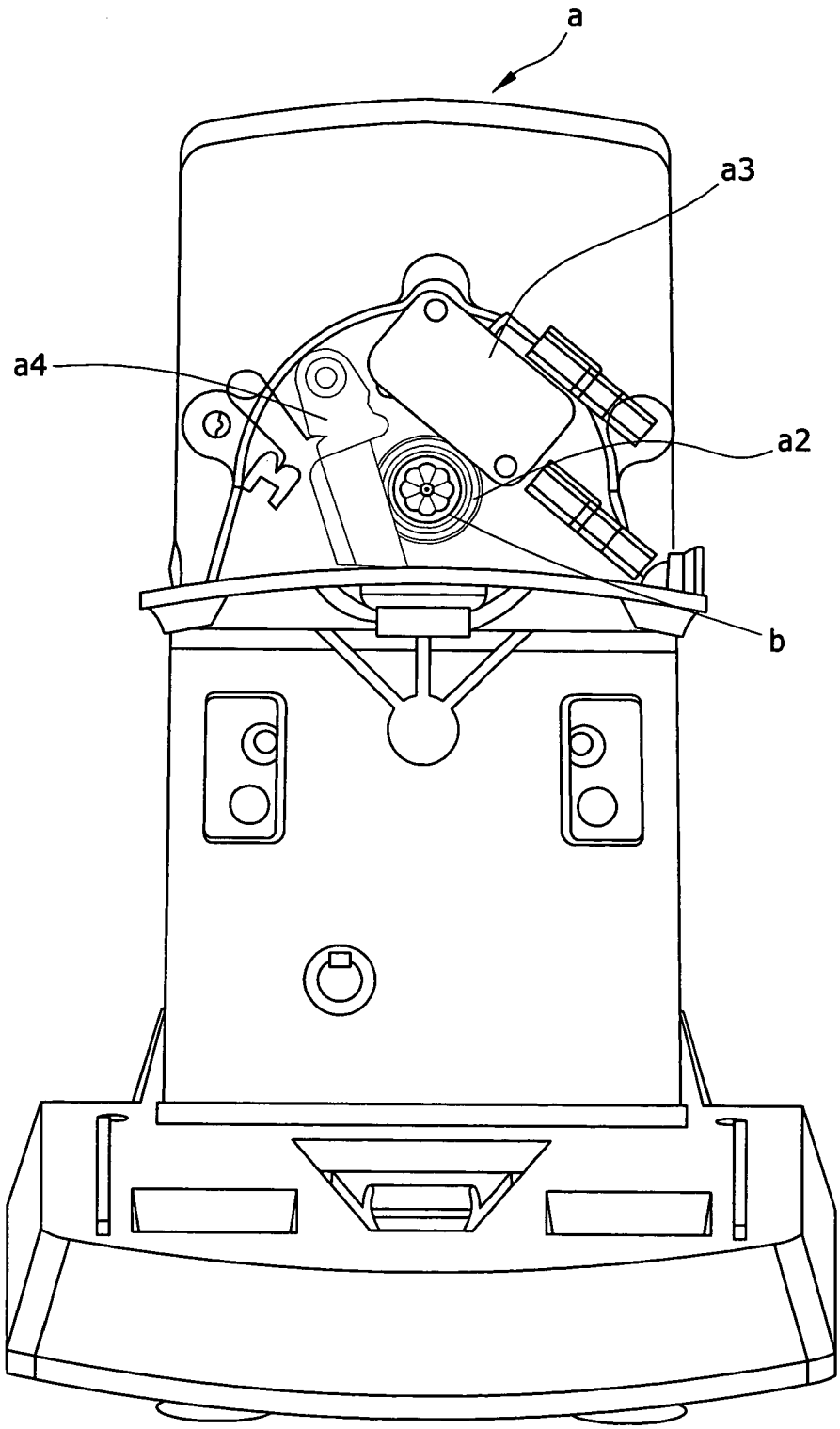
Fig.3(PRIOR ART)
FIG. 3 shows a front elevational view of the conventional sharpener (2)
Figure 4:
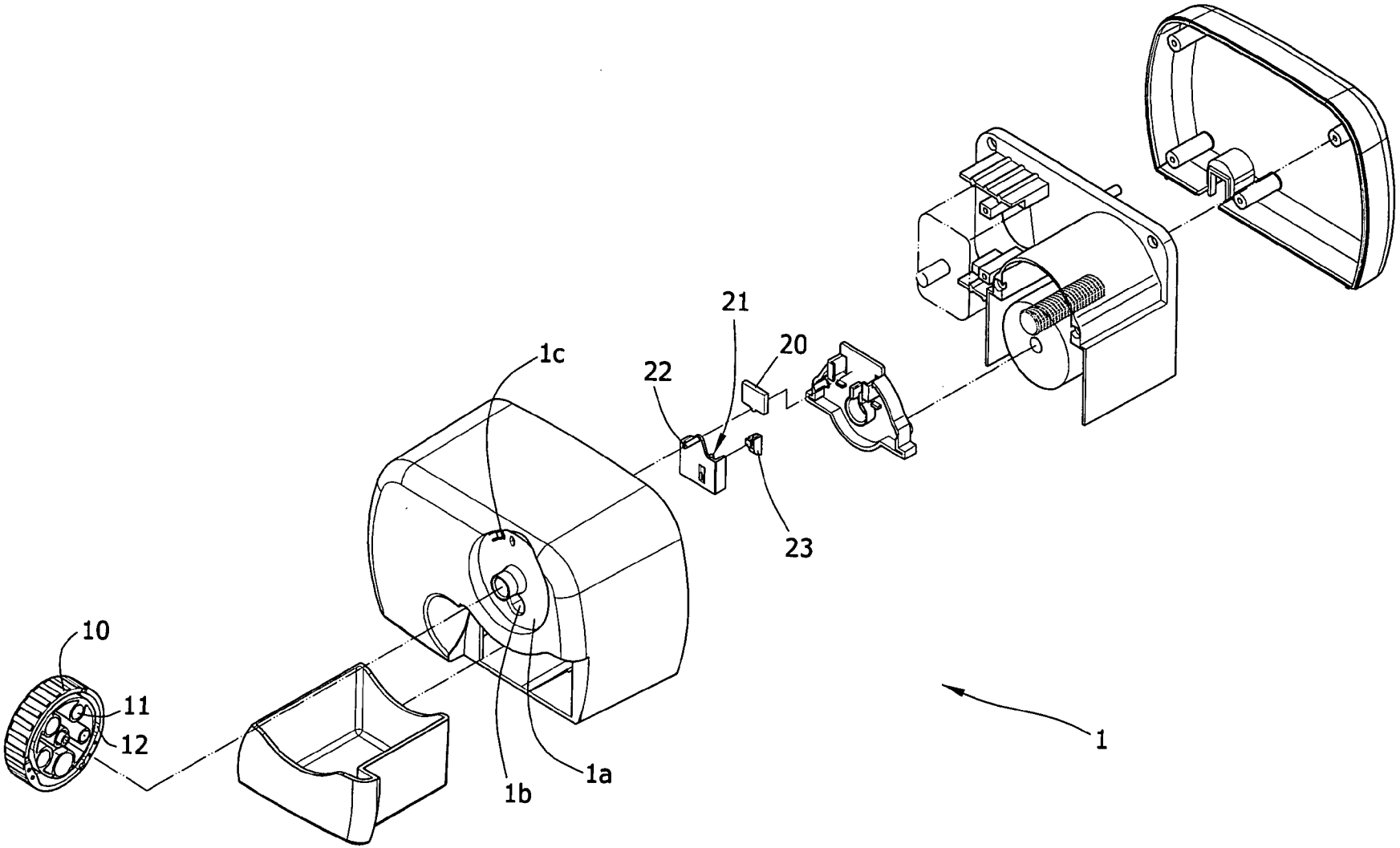
FIG. 4 shows an exploded view of the present invention.
Figure 5:
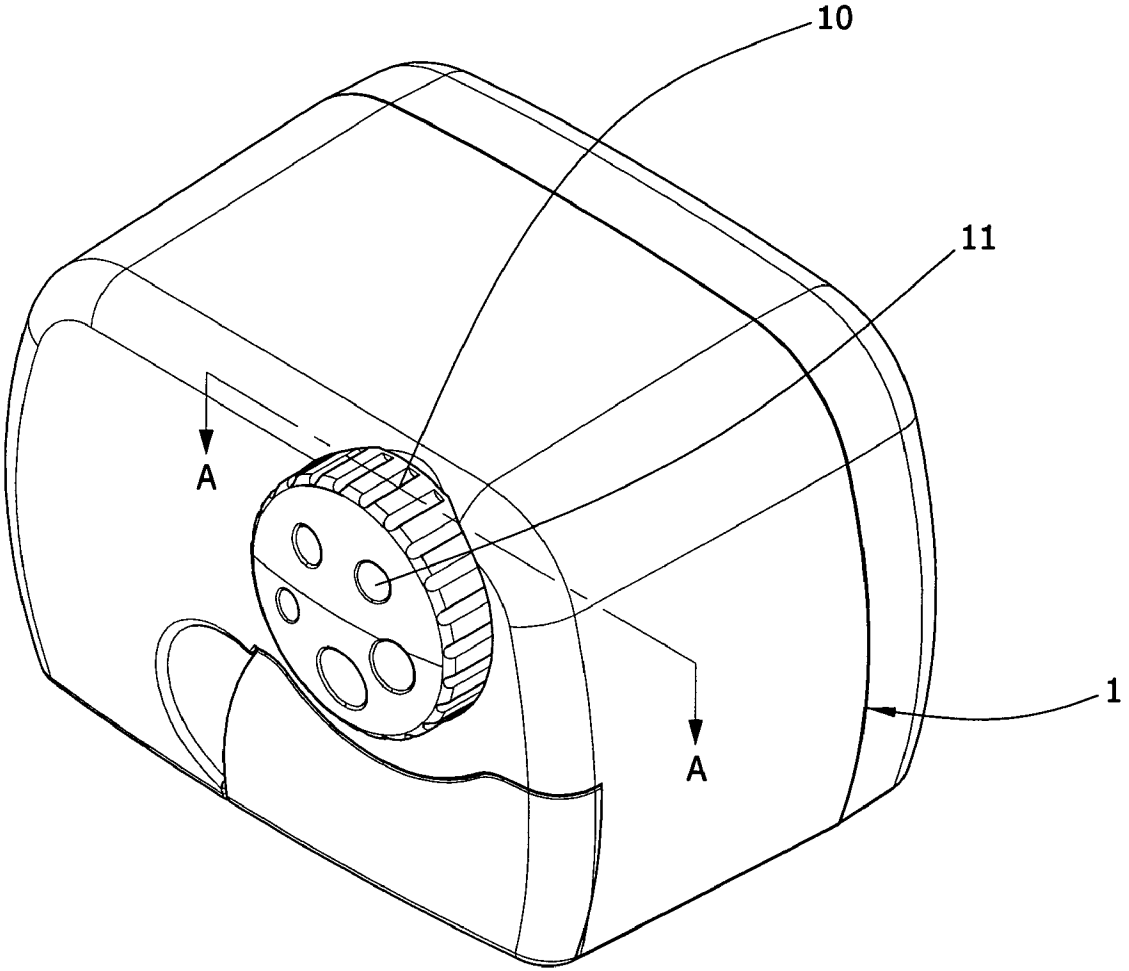
FIG. 5 shows a perspective view of the present invention.
Figure 6:
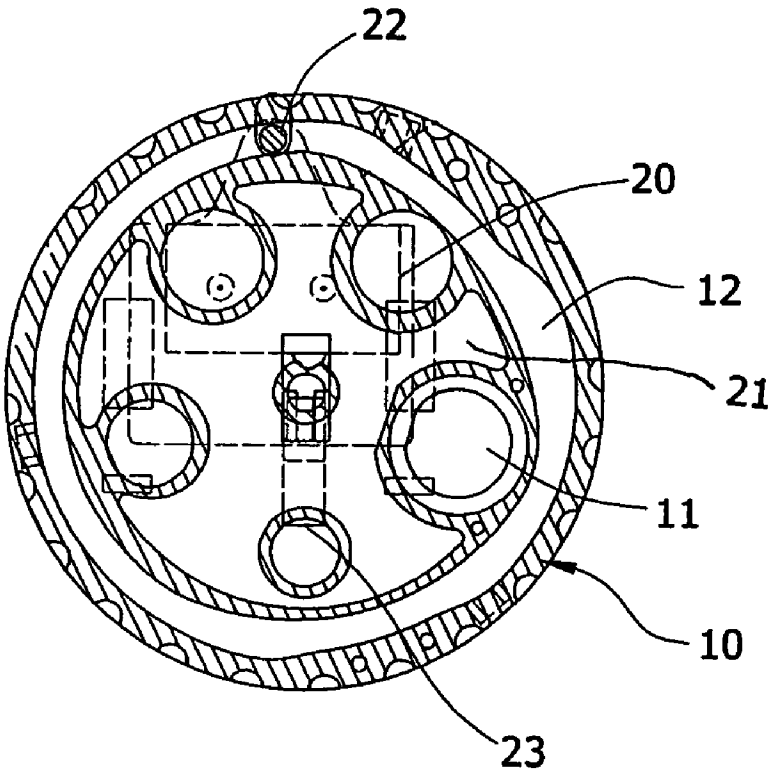
FIG. 6 shows a partially cross-sectional view of the present invention.

FIGS. 4-6 show an automatic pencil sharpener in accordance with the present invention primarily comprises a pencil sharpener body 1, and a pencil selector panel 10.

A plurality of pencil selecting openings 11 are set up in front of the pencil selector panel 10 which has annulus groove 12 at the rear side of the pencil selector panel 10. The pencil selector panel 10 is mounted on the emplacing groove 1*a* at the front side of the pencil sharpener body 1. A pencil receiving opening 1*b* and a plurality of pawls 1*c* are located in the emplacing groove. A trigger switch 20 is arranged close to the pencil receiving opening 1*b* and is within a position groove 21. Above the trigger switch 20, a trigger key 23 and a trigger 22 corresponding to the size of annulus groove 12 are fixed.

Figure 8:
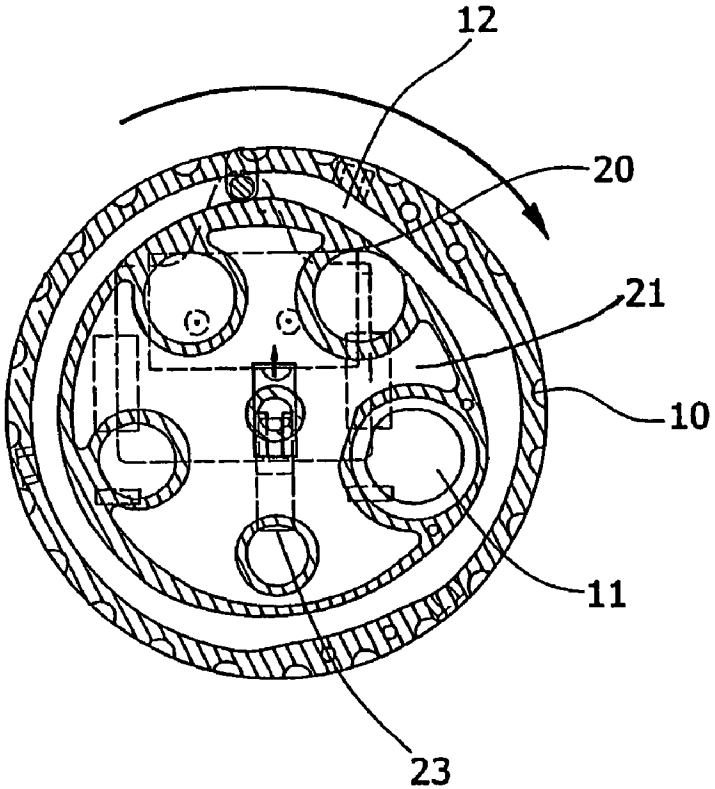
FIG. 8 shows another operation view of the present invention.
Figure 7:
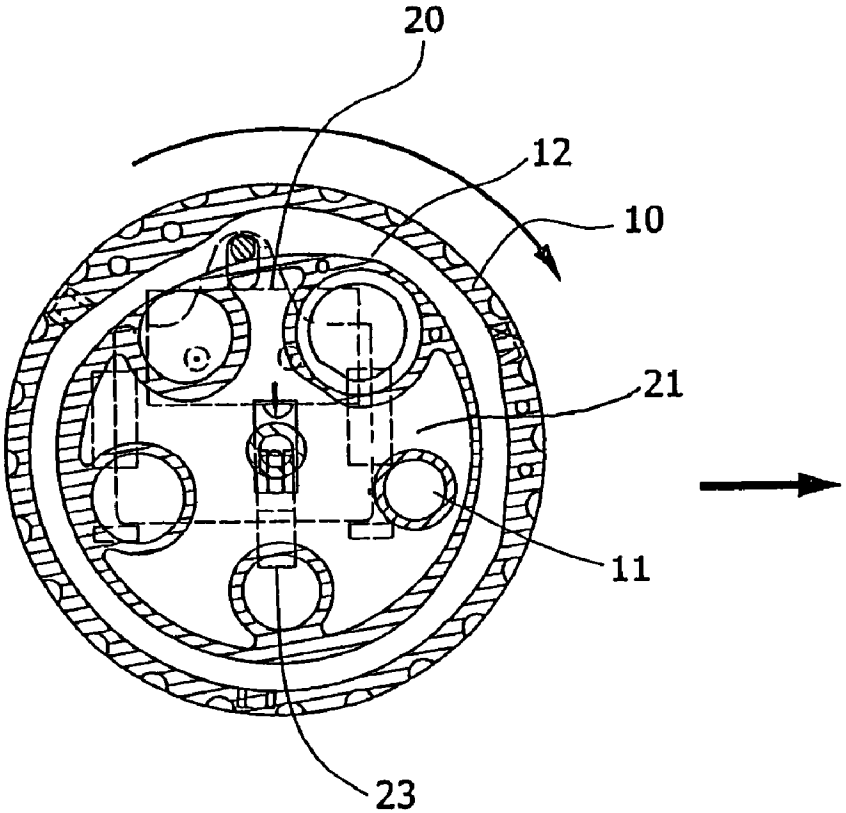
FIG. 7 shows a operation view of the present invention.

As shown in FIGS. 6-8, when rotating the pencil selector panel 10, the trigger 22 will move along with the inner circumference of the annulus groove 12, and drive the trigger switch 20 to move linearly along with position groove 21. Since the inner circumference of the annulus groove 12 have different curvatures and there are the predefined distances among the corresponding pencil openings 11, the location of the trigger key 23 will move to the selected pencil opening 11 when the pencil selector panel 10 rotates.

In summary, the Automatic Pencil Sharpener utilizes the movement of the pencil selector panel to drive the trigger to move in the annulus groove and drive trigger switch to move linearly. Therefore, the pencil insertion and removal will be easier.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pencil sharpener comprises:

a pencil sharpener body having an emplacing groove;

a front pencil selector panel including:

a plurality of different sizes of pencil selecting openings at a front side of the front pencil selector panel; and an annulus groove at a back side of the front pencil selector panel, the annulus groove surrounding the pencil selecting openings;

wherein the front pencil selector panel is mounted on the emplacing groove of the pencil sharpener body, and a pencil receiving opening and a plurality of pawls are located in the emplacing groove;

a blade inside the pencil sharpener body for sharpening a pencil;

a trigger switch located inside the pencil sharpener body and adjacent to the pencil receiving opening;

a trigger located within the annulus groove, the trigger moving along an inner wall of the annulus groove to drive the trigger switch to move linearly when the front pencil selector panel is rotated such that a selected one of the pencil selecting openings faces the pencil receiving opening.

2. The pencil sharpener of claim 1, wherein the trigger is spaced apart from the pencil selecting openings so as to being free of contact with a pencil when the pencil is inserted into the selected one of the pencil selecting openings.

3. The pencil sharpener of claim 1, wherein the trigger is in contact with the inner wall of the annulus groove.

4. The automatic pencil sharpener of claim 1, wherein the trigger is located in the annulus groove and travels along the annulus groove when the front pencil selector panel is rotated.

* * * * *